US007958925B2

(12) United States Patent
Murray

(10) Patent No.: US 7,958,925 B2
(45) Date of Patent: Jun. 14, 2011

(54) GARAGE DOOR STORAGE DEVICE

(76) Inventor: Matthew Murray, Anna, OH (US)

( * ) Notice: Subject to any disclaimer, the term of this patent is extended or adjusted under 35 U.S.C. 154(b) by 86 days.

(21) Appl. No.: 12/564,475

(22) Filed: Sep. 22, 2009

(65) Prior Publication Data

US 2011/0067310 A1 Mar. 24, 2011

(51) Int. Cl.
*E06B 9/00* (2006.01)

(52) U.S. Cl. ..... 160/127; 160/201; 211/119.004

(58) Field of Classification Search ..... 160/127, 160/201; 211/86.01, 87.01, 88.01, 119.004; 49/70, 197, 199; 232/19
See application file for complete search history.

(56) References Cited

U.S. PATENT DOCUMENTS

| | | | | |
|---|---|---|---|---|
| 1,500,991 | A * | 7/1924 | Heitler | 4/608 |
| 2,569,290 | A * | 9/1951 | Collester | 160/127 |
| 3,276,512 | A * | 10/1966 | Gallagher | 160/368.1 |
| 3,546,721 | A * | 12/1970 | Cleary | 5/97 |
| 4,664,266 | A * | 5/1987 | Fausett et al. | 211/87.01 |
| D291,754 | S * | 9/1987 | Griswold | D6/553 |
| 5,007,645 | A | 4/1991 | Weigl | |
| 5,337,907 | A * | 8/1994 | McKenzie et al. | 211/88.01 |
| 5,492,272 | A * | 2/1996 | Fewer | 232/19 |
| 5,785,188 | A * | 7/1998 | Ogden | 211/88.01 |
| 6,026,886 | A * | 2/2000 | Diamond-Martinez | 160/113 |
| 6,202,261 | B1 | 3/2001 | Moore | |
| 6,276,539 | B1 * | 8/2001 | Richbourg | 211/70.8 |
| 6,821,600 | B1 | 11/2004 | Henson | |
| 7,240,823 | B1 * | 7/2007 | Saidiazar et al. | 232/19 |
| 7,543,538 | B2 | 6/2009 | Baez | |
| 7,866,493 | B1 * | 1/2011 | Hurt et al. | 211/119.004 |
| 2002/0043543 | A1 | 4/2002 | McMurray | |
| 2006/0038468 | A1 * | 2/2006 | Morgan | 312/245 |
| 2009/0184159 | A1 * | 7/2009 | Crawford | 232/19 |

* cited by examiner

*Primary Examiner* — Blair M. Johnson
(74) *Attorney, Agent, or Firm* — R. William Graham

(57) ABSTRACT

A storage device for use with a garage door having at multiple panels wherein each panel has a given width and height, the panels connected together by hinges and fasteners at predetermined spacing across the panels, wherein the fasteners are generally disposed in vertical alignment at a top part and bottom part of at least one of the panels, and which includes a storage container having a peripheral support structure which is normally maintained adjacent the panel and includes a plurality of eyelets formed on a top part and bottom part thereof which are of a size to receive one of the fasteners therethrough and are spaced along the peripheral support structure in a manner such that when receiving the fasteners said storage device is maintained adjacent the panel generally within the width and height of the panel.

29 Claims, 3 Drawing Sheets

GARAGE DOOR STORAGE DEVICE

BACKGROUND AND SUMMARY OF THE INVENTION

1. Field of Invention

The invention relates to a storage device. More particularly, the invention relates to a storage device especially for garage door panels, with at least one receiving pocket that provides access to the interior of the pocket from one open side.

2. Related Art

Storage devices for various purposes exist. As to one type of storage device, there exist storage nets with a closable loop end. Such nets can include a stretchable mesh net for use on a car trunk which is closed at its edges except for a top side, through which access is permitted to the interior of the mesh net. The side edges of the open top side can be provided with pull cords to enable closure. The mesh net can form a receiving pocket that can be hung on retaining buttons integral with the vehicle in a trunk or cargo compartment of a motor vehicle. The net is generally configured of an elastic material to permit stretching to accommodate holding various sized objects.

There is a need to provide a storage device which is particularly useful in a garage.

SUMMARY OF THE INVENTION

It is an object to improve storage devices.

It is a further object to provide a storage device for a garage door.

It is another object to provide a garage door with a storage device.

Accordingly, the present invention relates to a storage device for use with a garage door having multiple hinged panels which are counter-balanced during opening and closing movement relative to roller guide tracks by strong springs. The counter-balance can use either dual extension springs mounted above the left and right hand horizontal tracks or torsion springs mounted on the level header above the door opening to accommodate for a predetermine weight load.

The present invention takes into consideration that the device of the instant invention must have certain restrictions to avoid risk of injury or malfunction of the door. For example, use garage doors torsion springs require special lever bars for adjusting door balance during opening and closing movement and take into account a predetermined weight load.

A garage door will have multiple panels interconnected by sets of inwardly facing hinges. For example, there can be four door panels interconnected by three sets of four hinges. The lower outside of each panel can mount an idler roller which will guide the door panels during movement within two a vertical and horizontal roller guide tracks.

The hinges are spaced apart a fixed predetermined distance and fall within vertical and horizontal alignment to respective adjacent hinges. Each hinge interconnects adjacent panels by way of one or more bolt and nut. For example, each door panel could have eight hinges and bolt connections, with four running parallel to the other four and there being four vertically spaced pairs of bolts across each panel.

The storage device includes a support structure which is configured with a periphery, such as a strap, which includes a plurality of eyelets, e.g. four or eight grommets, which are of a size to receive and are spaced therealong in a manner to be aligned for connection with bolts of the garage door to maintain the net adjacent the panel. Retained within the peripheral strap can be an envelope netting wherein one portion of the netting is generally folded on itself with sides and bottom forming an enclosure and top which is open to expose an interior of the enclosure. The peripheral strap can include a continuous piece or multiple pieces stitched or otherwise fixed together. The width and length of the net is generally configured to reside generally within a door panel size to prevent unwanted binding of the net with an adjacent door panel connection as the garage door moves from one position to another, e.g., vertical to horizontal.

Along adjacent edges of the top are fasteners which interconnect the edges to selectively maintain closure. Fasteners can include snaps formed in the strap or hook and loop material or a hooks. Preferably the netting can be of limited stretchability. In this regard, the net is limited in sagging. The straps can include printed indicia which indicate a predetermined weight limit to be stored in the net.

By opening the top, one can insert and remove an object in the receiving enclosure. The solution according to the invention provides for increased storage in a space of the garage which would otherwise be not use. Further, the invention takes into account size limitations in aiding to prevent binding of the door panels as well as limiting the not over packing the net to cause a weight safety concern.

It is contemplated that different materials can also be used such as, but not limited to, textile, plastic or synthetics. Additional advantages and features of the invention follow from the claims as well as from the following description of preferred embodiments of the invention shown in the drawings.

DETAILED DESCRIPTION OF THE DRAWINGS

Figure 1:
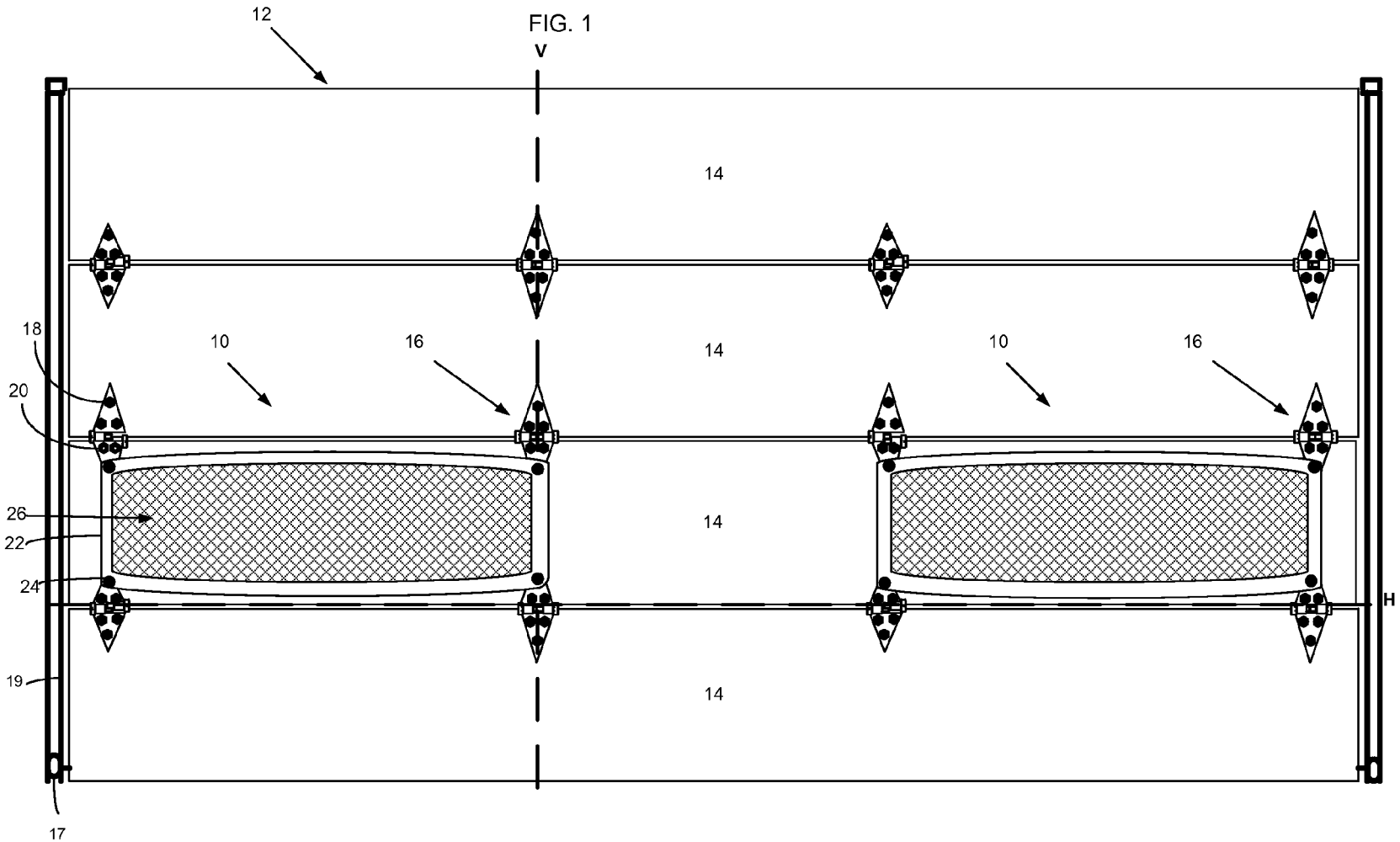
FIG. 1 shows a straight on plan view of one embodiment of the storage device according to the invention.

Referring now to the drawings, the storage device for use with a garage door of the present invention is referred to generally by the numeral 10. The garage door is generally referred to by the numeral 12. The garage door 12 can have multiple panels 14 interconnected by sets of inwardly facing hinges 16. As seen in the drawings, a portion of door panel 14 is seen interconnected by sets of four (4) hinges 16.

The lower outside of each panel 14 will mount an idler roller as is known in the art which will guide the door panels 14 during movement within vertical and horizontal roller guide tracks. Each hinge 16 includes a plurality of bolts 18. The hinges 16 are spaced apart a fixed predetermined distance, such as 45-47 inches, for example, and fall within vertical and horizontal alignment to respective adjacent hinges 16 as seen in imaginary lines V and H. Each hinge 16 interconnects adjacent panels 14 by way of one or more bolt 18 and nut 20. For example, each door panel 14 could have eight hinges 16 and bolt 18/nut 20 connections, with four running parallel to the other four and there being four vertically spaced pairs of bolts 18 and nuts 20 across each panel 14.

The storage device 10 can include a support structure which can be configured with a peripheral strap 22 which includes a plurality of, e.g. four or eight, grommets 24 which are of a size to receive and are spaced therealong in a manner to be aligned for connection with bolts 18 of the garage door 12 to maintain the netting 26 adjacent the panel 14. In one embodiment, retained within the peripheral strap 22 is an envelope netting 26. As seen in FIG. 1, the strap 22 and netting 26 can in conjunction with the garage 12 door form a means for containing objects there between. In this version, strap 22 is normally maintained adjacent and can be sufficiently displaced and elastic to permit opening and closing, yet when released, retracts to its position against the panel 14.

Figure 2:
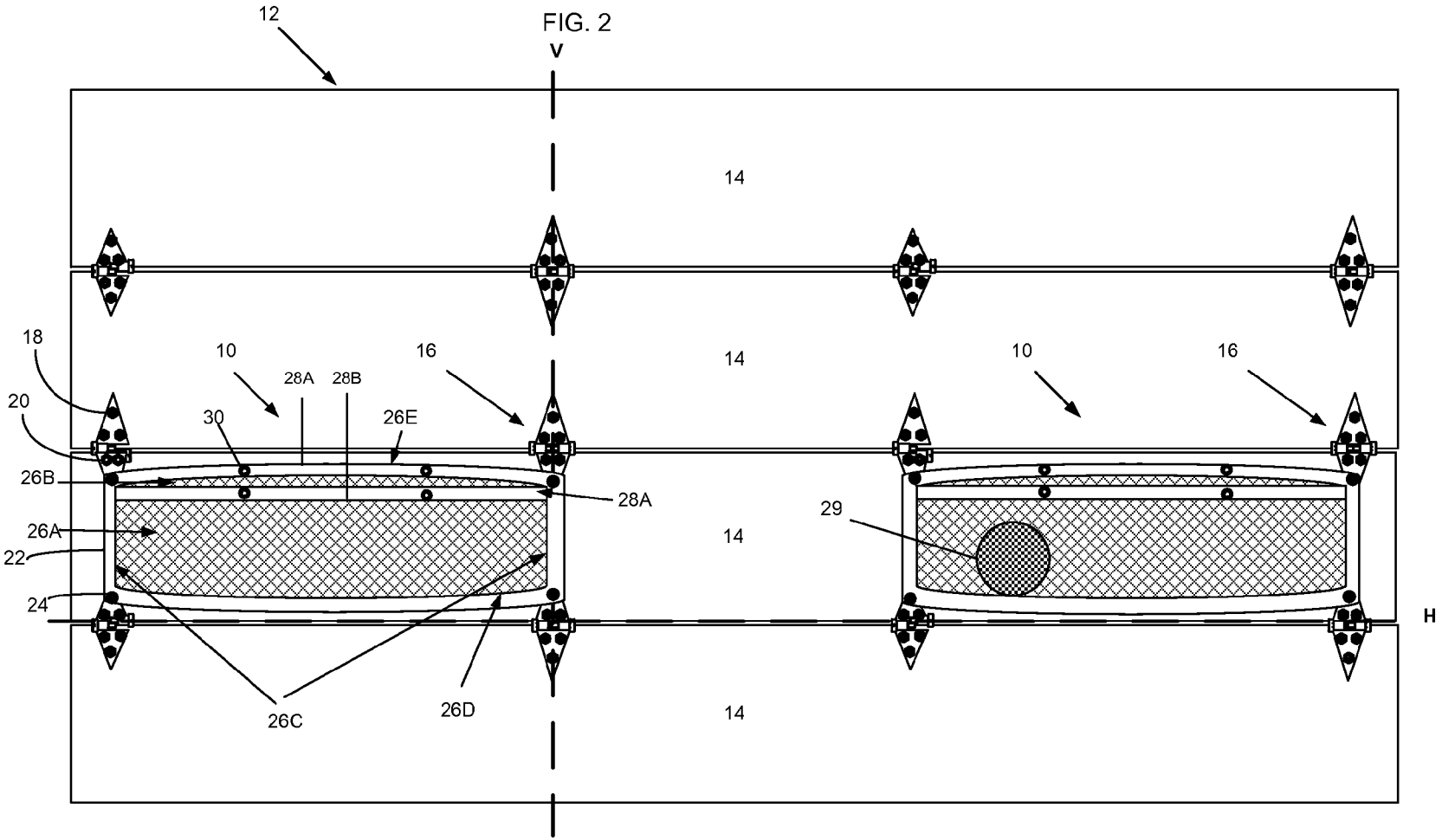
FIG. 2 is a view of another embodiment of a storage device according to the invention in a both unloaded resting and loaded positions on a garage door.

In FIG. 2, an alternative embodiment is provided wherein portion 26A and 26B of the netting is generally folded over with sides 26C and bottom 26D forming an enclosure and top 26E which is open to expose an interior of the enclosure. The peripheral strap 22 can include a continuous piece or multiple pieces of material, such as nylon, polypropylene or polyester for example, stitched or otherwise fixed together. The width and length of the strap 22 and netting 26 is configured to reside generally within and not exceed a size of a panel 14 to prevent unwanted binding of the strap 22 and netting 26 with an adjacent panel 14 connection as the garage door 12 moves from one position to another.

Along adjacent edges 28A and 28B of the top are fasteners 30 which interconnect the edges 28A and 28B to selectively maintain closure. Fasteners 30 can include snaps formed in the strap 22 or hook and loop material or hooks, for example. Preferably the netting should be of limited stretchability. In this regard, the device 10 has a limited volume defined by the enclosure and is limited in sagging into an area of an adjacent panel potentially causing a binding issue or overfilling of the net. The straps 22 can include printed indicia which indicate a predetermined weight limit to be stored in the device 10. This further reduces potential risk of failure in the garage door 12. The device 10 is ideally designed for relatively lightweight objects such as small toys or sporting good items, like a Frisbee™ 29, baseball and glove, etc. or towel, rags or work gloves. Thus, there is a place created for easy storage and access for items which may be frequently used.

By opening the top edges 28A and 28B, one can insert and remove an object in the receiving enclosure. The solution according to the invention provides for increased storage in a space of the garage which could otherwise be not used. Further, the invention takes into account size limitations in aiding to prevent binding of the door panels 14 as well as limiting over packing the netting 26 to cause a weight safety concern.

Figure 3:
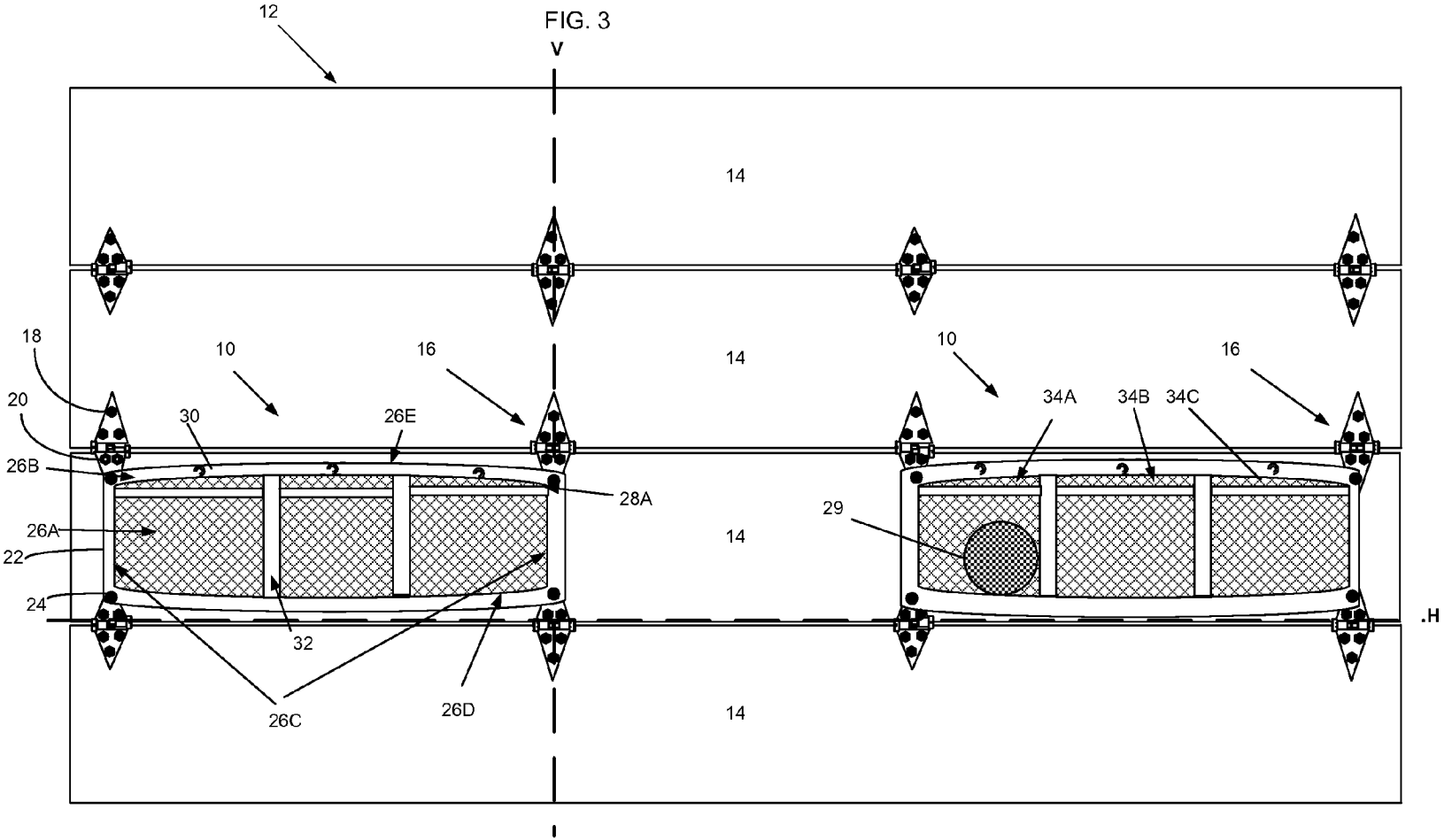
FIG. 3 shows yet another embodiment of the invention of a storage device according to the invention in a both unloaded resting and loaded positions on a garage door.

It is contemplated that different materials can also be used such as, but not limited to, textile, plastic or synthetics. As shown in FIG. 2, the netting 26 is positioned adjacent the panel 14 by securing the grommets 24 about the bolts 18 with the strap 22 being preferably taut. The strap 22 may be of a continuous piece or multiple pieces which is fixed together in a manner known to the art. The device 10 may include a single enclosure, or can include a number of enclosures as it is envisioned that the device 10 can include vertical connecting strips 32 laterally spaced from one another which serve to interconnect portions 26A and 26B in a manner to form multiple enclosures as seen in FIG. 3. There can thus be formed a number of pockets 34A, 34B and 34C, for example, of same or different sizes. In this regard, the pockets further restrict the size of the objects which can be disposed therein and further aid against overweighting the device 10. The pockets 34A-34C can alternatively be formed of a sheet like or plastic material and in such case connected by seam can in the vicinity of and without the need of connecting strips for example.

The embodiments described herein are set forth merely to illustrate the invention and is not intended to be limiting. Modifications, derivations and improvements of the disclosed embodiments incorporating the spirit and substance of the invention may occur to persons skilled in the art, the invention should be construed to include everything within the scope of the appended claims and equivalents thereof.

What is claimed is:

1. A storage device for use with a garage door having multiple panels wherein each panel has a predetermined width and height, the panels connected together by hinges and fasteners at predetermined spacing across the panels, wherein the fasteners are disposed in vertical alignment at a top part and bottom part of at least one of the panels, and wherein the garage door is counter-balanced during opening and closing movement relative to roller guide tracks to accommodate for a predetermined weight load, which includes:

a storage container having a peripheral support structure which is normally maintained adjacent a panel and includes a plurality of eyelets formed on a top part and bottom part thereof which are of a size to receive one of the fasteners therethrough and are spaced along the peripheral support structure in a manner such that when receiving the fasteners said storage container is maintained adjacent the panel generally within the width and height of the panel.

2. The storage device of claim 1, wherein said container is a net which is configured with a peripheral strap and wherein said eyelets include grommets formed thereat.

3. The storage device of claim 2, wherein said peripheral strap extends along a top of said net and a bottom of said net to form an enclosure and wherein said top is openable to expose an interior of said enclosure.

4. The storage device of claim 3, which includes second fasteners connected to the top to selectively maintain closure.

5. The storage device of claim 4, wherein said second fasteners include snaps formed in said strap.

6. The storage device of claim 4, wherein said second fasteners include one of hook and loop material and hooks connected to said strap.

7. The storage device of claim 2, wherein said net is limited in stretchability to aid in preventing undue sagging when containing items therein.

8. The storage device of claim 1, wherein said storage container includes a pocket with a top which is open to expose an interior of said pocket.

9. The storage device of claim 8, which includes second fasteners connected to the top to selectively maintain closure.

10. The storage device of claim 9, wherein said second fasteners include snaps formed in the top.

11. The storage device of claim 9, wherein said second fasteners include hook and loop material.

12. The storage device of claim 1, which further includes printed indicia indicating a predetermined weight limit to be stored therein.

13. The storage device of claim 8, which includes a plurality of pockets.

14. The storage device of claim 3, which includes at least one inwardly oriented connecting strip laterally spaced from ends of said net which serves to interconnect portions of said net in a manner to form multiple enclosures.

15. A storage device, which includes:

a garage door having multiple panels wherein each panel has a given width and height, said panels connected together by hinges and fasteners at predetermined spacing across the panels, wherein said fasteners are disposed in alignment at a top part and bottom part of at least one of said panels; and a storage container having a peripheral support structure normally maintained adjacent a panel including a plurality of eyelets formed on a top part and bottom part thereof which are of a size to receive one of the fasteners therethrough and are spaced along the peripheral support structure in a manner such that when receiving said fasteners said storage container is maintained adjacent the panel generally within the width and height of the panel.

16. The storage device of claim 15, wherein said support structure is limited in stretchability.

17. The storage device of claim 16, wherein said container is a net which is configured with a peripheral strap and wherein said eyelets include grommets formed thereat.

18. The storage device of claim 17, wherein said peripheral strap extends along a top of said net and a bottom of said net to form an enclosure with a top which is openable to expose an interior of said enclosure.

19. The storage device of claim 18, which includes second fasteners connected to the top to selectively maintain closure.

20. The storage device of claim 19, wherein said second fasteners include snaps formed in said strap.

21. The storage device of claim 19, wherein said second fasteners one of hook and loop material and hooks connected to said strap.

22. The storage device of claim 17, wherein said net is of limited stretchability.

23. The storage device of claim 16, wherein said storage container includes a pocket with a top which is open to expose an interior of said pocket.

24. The storage device of claim 23, which includes second fasteners connected to the top to selectively maintain closure.

25. The storage device of claim 24, wherein said second fasteners include snaps formed in the top.

26. The storage device of claim 24, wherein said second fasteners include hook and loop material.

27. The storage device of claim 15, which includes printed indicia indicating a predetermined weight limit to be stored therein.

28. The storage device of claim 24, which includes a plurality of pockets.

29. The storage device of claim 17, which includes at least one inwardly oriented connecting strip laterally spaced from ends of said net which serves to interconnect portions of said net in a manner to form multiple enclosures.

* * * * *